US009982490B2

(12) United States Patent
Fuller et al.

(10) Patent No.: US 9,982,490 B2
(45) Date of Patent: May 29, 2018

(54) METHODS OF ATTACHING CUTTING ELEMENTS TO CASING BITS AND RELATED STRUCTURES

(71) Applicant: Baker Hughes Incorporated, Houston, TX (US)

(72) Inventors: Wesley Dean Fuller, Willis, TX (US); Suresh G. Patel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 581 days.

(21) Appl. No.: 13/782,838

(22) Filed: Mar. 1, 2013

(65) Prior Publication Data

US 2014/0246254 A1 Sep. 4, 2014

(51) Int. Cl.

| | |
|---|---|
| ***B21K 5/04*** | (2006.01) |
| ***E21B 10/573*** | (2006.01) |
| ***E21B 17/14*** | (2006.01) |

(52) U.S. Cl.

CPC ..... *E21B 10/5735* (2013.01); *E21B 17/14* (2013.01)

(58) Field of Classification Search

CPC ..... E21B 10/5735; E21B 17/14; E21B 10/42; E21B 2010/425; E21B 10/43; E21B 10/55

USPC ..... 76/108.1–108.4; 175/57, 230, 402, 175/325.2, 426, 428, 433, 374, 327, 171, 175/434, 420.2

See application file for complete search history.

(56) References Cited

U.S. PATENT DOCUMENTS

| | | | | |
|---|---|---|---|---|
| 3,745,623 | A | 7/1973 | Rocco et al. | |
| 4,359,112 | A * | 11/1982 | Garner | E21B 10/04 175/336 |
| 4,686,080 | A * | 8/1987 | Hara | B23B 27/20 228/122.1 |
| 4,906,528 | A | 3/1990 | Cerceau et al. | |
| 5,009,673 | A | 4/1991 | Cho | |
| 5,030,276 | A * | 7/1991 | Sung | B22F 7/06 175/433 |
| 5,075,053 | A * | 12/1991 | Bernadic | B22F 3/1275 264/109 |
| 5,755,289 | A | 5/1998 | Angman et al. | |
| 6,199,641 | B1 | 3/2001 | Downie et al. | |

(Continued)

FOREIGN PATENT DOCUMENTS

WO 2011012708 A1 2/2011

OTHER PUBLICATIONS

Bailey, Greg, The Evolution of Expandable Technology, Journal of Petroleum Technology, Mar. 2009, pp. 36 and 38.

(Continued)

*Primary Examiner* — Ghassem Alie
*Assistant Examiner* — Bharat C Patel
(74) *Attorney, Agent, or Firm* — TraskBritt

(57) ABSTRACT

A method of forming a casing bit includes positioning a cutting element adjacent an outer surface of a casing bit body. The cutting element has a superhard material and a bonding material that is used to bond the cutting element to a body of the casing bit. The bonding material may be a weldable or brazable metal alloy, and a welding process or a brazing process, respectively, may be used to bond the cutting elements to body of the casing bit. Casing bits fabricated using such methods may exhibit reduced bond strength between the cutting elements and the casing bit body.

19 Claims, 4 Drawing Sheets

(56) References Cited

U.S. PATENT DOCUMENTS 6,227,306 B1 5/2001 Downie et al.
6,311,792 B1 11/2001 Scott
6,454,027 B1 * 9/2002 Fang ..... C09K 3/1418 175/374
6,513,223 B1 2/2003 Angman et al.
6,585,052 B2 7/2003 Angman et al.
6,679,335 B2 1/2004 Slack et al.
6,705,413 B1 3/2004 Tessari
6,742,584 B1 6/2004 Appleton
6,742,611 B1 * 6/2004 Illerhaus ..... E21B 10/5735 175/433
6,843,333 B2 * 1/2005 Richert ..... E21B 10/46 175/379
6,899,356 B2 5/2005 Slack et al.
7,013,992 B2 * 3/2006 Tessari ..... E21B 7/20 175/325.2
7,021,382 B2 4/2006 Angman
7,044,241 B2 5/2006 Angman
7,082,997 B2 8/2006 Slack
7,090,004 B2 8/2006 Warren et al.
7,108,080 B2 9/2006 Tessari et al.
7,124,825 B2 10/2006 Slack
7,140,443 B2 11/2006 Beierbach et al.
7,140,455 B2 11/2006 Walter et al.
7,216,565 B2 * 5/2007 Sherwood, Jr. ..... E21B 10/55 76/108.1
7,219,727 B2 5/2007 Slack et al.
7,237,607 B2 7/2007 Angman et al.
7,270,189 B2 9/2007 Brown et al.
7,287,584 B2 10/2007 Angman et al.
7,328,742 B2 2/2008 Slack
7,347,286 B2 3/2008 Hu
7,370,712 B2 5/2008 Stout et al.
7,377,324 B2 5/2008 Beierbach et al.
7,395,882 B2 * 7/2008 Oldham ..... E21B 7/20 166/242.8
7,428,927 B2 9/2008 Vert et al.
7,435,377 B2 10/2008 Cho et al.
7,472,763 B2 1/2009 Slack et al.
7,475,742 B2 1/2009 Angman et al.
7,484,559 B2 2/2009 Vert et al.
7,487,849 B2 * 2/2009 Radtke ..... E21B 10/5735 175/420.2
7,516,804 B2 * 4/2009 Vail ..... E21B 10/567 175/420.2
7,520,343 B2 4/2009 Hughes et al.
7,552,778 B2 6/2009 Slack
7,575,061 B2 8/2009 Angman et al.
7,578,640 B2 * 8/2009 Hecht ..... B23B 27/16 407/103
7,604,057 B1 10/2009 Eriksen et al.
7,624,820 B2 12/2009 Angman et al.
7,637,330 B2 12/2009 Angman et al.
7,640,984 B2 1/2010 Vert et al.
7,647,990 B2 1/2010 Tessari et al.
7,654,313 B2 2/2010 Angman
7,673,675 B2 3/2010 Carr et al.
7,681,649 B2 3/2010 Cerovsek
7,694,730 B2 4/2010 Angman
7,708,077 B2 5/2010 Eriksen et al.
7,721,798 B2 5/2010 Angman
7,726,421 B2 * 6/2010 Middlemiss ..... C04B 35/52 175/420.2
7,814,998 B2 * 10/2010 Patel ..... E21B 10/567 175/432
7,828,089 B2 * 11/2010 Buske ..... B23K 9/048 175/340
7,842,111 B1 * 11/2010 Sani ..... F16C 33/26 175/374
8,109,350 B2 2/2012 Fang et al.
8,192,113 B2 * 6/2012 Limell ..... B23B 27/1614 407/113
8,201,648 B2 * 6/2012 Choe ..... B22D 19/14 175/327
8,216,677 B2 * 7/2012 Mukhopadhyay ..... B01J 3/062 428/408
8,220,567 B2 * 7/2012 Scott ..... E21B 10/54 175/426
8,236,074 B1 * 8/2012 Bertagnolli ..... B24D 99/005 175/420.2
8,261,632 B2 * 9/2012 Stevens ..... B22F 7/062 76/108.4
8,309,018 B2 * 11/2012 Smith ..... B22F 7/062 175/425
8,408,338 B2 * 4/2013 Richert ..... E21B 10/43 175/425
8,439,137 B1 * 5/2013 Galloway ..... E21B 10/573 175/432
8,727,044 B2 * 5/2014 Qian ..... B22F 5/00 175/420.2
8,727,046 B2 * 5/2014 Miess ..... B01J 3/062 175/420.2
8,887,836 B2 * 11/2014 Williams ..... E21B 37/02 175/327
8,887,839 B2 * 11/2014 Vempati ..... E21B 10/43 175/426
8,911,522 B2 * 12/2014 Cleboski ..... E21B 10/46 51/293
8,960,332 B2 * 2/2015 Ugwuocha ..... E21B 10/42 175/171
8,985,244 B2 * 3/2015 Patel ..... E21B 10/46 175/374
8,986,408 B1 * 3/2015 Sani ..... B24D 3/06 423/446
9,068,408 B2 * 6/2015 Vempati ..... E21B 10/43
9,487,847 B2 * 11/2016 Mukhopadhyay ..... B22F 7/062
2004/0155096 A1 * 8/2004 Zimmerman ..... B23K 3/06 228/248.1
2006/0231250 A1 10/2006 Slack
2007/0034416 A1 * 2/2007 Cho ..... B22F 7/062 175/434
2007/0068703 A1 3/2007 Tessari
2008/0053660 A1 3/2008 Angman
2008/0093127 A1 4/2008 Angman
2008/0150305 A1 6/2008 Hollin
2008/0164019 A1 7/2008 Angman
2008/0196904 A1 8/2008 Angman
2008/0210439 A1 9/2008 Angman et al.
2009/0090508 A1 4/2009 Brouse
2009/0101345 A1 4/2009 Moffitt et al.
2009/0107675 A1 4/2009 Eriksen et al.
2009/0151931 A1 6/2009 Angman
2009/0242192 A1 10/2009 Jensen et al.
2009/0288821 A1 11/2009 Eriksen et al.
2009/0288839 A1 11/2009 Eriksen et al.
2009/0288841 A1 11/2009 Eriksen et al.
2009/0288886 A1 11/2009 Eriksen et al.
2009/0321086 A1 12/2009 Zimmermann
2010/0012328 A1 1/2010 Nikirofuk
2010/0025113 A1 2/2010 Warren et al.
2010/0025120 A1 2/2010 Warren
2010/0051352 A1 * 3/2010 Prevost ..... E21B 10/573 175/431
2010/0089658 A1 * 4/2010 Welch ..... E21B 10/43 175/374
2010/0096143 A1 4/2010 Angman
2010/0126734 A1 * 5/2010 Eriksen ..... E21B 10/64 166/385
2010/0175265 A1 * 7/2010 Bozikis ..... B26B 21/227 30/50
2010/0242375 A1 * 9/2010 Hall ..... B22F 3/14 51/307
2010/0320005 A1 * 12/2010 Burhan ..... B22F 7/06 175/426
2010/0326729 A1 * 12/2010 Marvel ..... E21B 7/20 175/57
2011/0061944 A1 * 3/2011 Scott ..... B01J 3/062 175/428

(56) References Cited

U.S. PATENT DOCUMENTS

| | | | | |
|---|---|---|---|---|
| 2011/0284294 | A1* | 11/2011 | Cox | E21B 10/43 175/431 |
| 2012/0138370 | A1* | 6/2012 | Mukhopadhyay | B22F 7/06 175/428 |
| 2015/0021099 | A1* | 1/2015 | Shaw | B24D 7/06 175/403 |

OTHER PUBLICATIONS

Enventure, How SET® Technology Works Data Sheet, Enventure Global Technology, 2009, 2 pages.
Felix, Vasco, Using Solid Expandable Tubular Technology to Optimize Operations, For JSTB (8émes Journées Scientifiques et Techniques), Enventure Global Technology, LLS, Algiers, Nov. 18-19, 2008, 14 pages.
Hughes Christensen, EZ Case, Casing Bit System, www.HCCbits.com, 2007, 2 pages.
Hughes Christensen, EZ Ream, Casing/liner shoe, www.HCCbits.com, 2007, 2 pages.

* cited by examiner

METHODS OF ATTACHING CUTTING ELEMENTS TO CASING BITS AND RELATED STRUCTURES

TECHNICAL FIELD

Embodiments of the present disclosure relate to casing bits configured to be coupled to wellbore casing having cutting elements thereon, to drilling assemblies including casing and such a casing bit, and methods of making and using such casing bits and drilling assemblies.

BACKGROUND

Wellbores are formed in subterranean formations for various purposes including, for example, extraction of oil and gas from the subterranean formation and extraction of geothermal heat from the subterranean formation. A wellbore may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

It is known in the art to use what are referred to in the art as a "reamer" devices (also referred to in the art as "hole opening devices" or "hole openers") in conjunction with a drill bit as part of a bottom hole assembly when drilling a wellbore in a subterranean formation. In such a configuration, the drill bit operates as a "pilot" bit to form a pilot bore in the subterranean formation. As the drill bit and bottom hole assembly advances into the formation, the reamer device follows the drill bit through the pilot bore and enlarges the diameter of, or "reams," the pilot bore.

After drilling a wellbore in a subterranean earth-formation, it may be desirable to line the wellbore with sections of casing or liner. Casing is relatively large diameter pipe (relative to the diameter of the drill pipe of the drill string used to drill a particular wellbore) that is assembled by coupling casing sections in an end-to-end configuration. Casing is inserted into a previously drilled wellbore, and is used to seal the walls of the subterranean formations within the wellbore. The casing then may be perforated at one or more selected locations within the wellbore to provide fluid communication between the subterranean formation and the interior of the wellbore. Casing may be cemented in place within the wellbore. The term "liner" refers to casing that does not extend to the top of a wellbore, but instead is anchored or suspended from inside the bottom of another casing string or section previously placed within the wellbore. As used herein, the terms "casing" and "casing string" each include both casing and liner, and strings respectively comprising sections of casing and liner.

As casing is advanced into a wellbore, it is known in the art to secure a cap structure to the distal end of the distal casing section in the casing string (the leading end of the casing string as it is advanced into the wellbore). As used herein, the term "distal" means distal to the earth surface into which the wellbore extends (i.e., the end of the wellbore at the surface), while the term "proximal" means proximal to the earth surface into which the wellbore extends. The casing string, with the cap structure attached thereto, optionally may be rotated as the casing is advanced into the wellbore.

The cap structure may be configured as what is referred to in the art as a casing "shoe," which is primarily configured to guide the casing into the wellbore and ensure that no obstructions or debris are in the path of the casing, and to ensure that no debris is allowed to enter the interior of the casing as the casing is advanced into the wellbore. The casing shoe may conventionally contain a check valve, termed a "float valve," to prevent fluid in the wellbore from entering the casing from the bottom, yet permit cement to be subsequently pumped down into the casing, out the bottom through the shoe, and into the wellbore annulus to cement the casing in the wellbore.

In other instances, the cap structure may be configured as a reaming shoe, which serves the same purposes of a standard casing shoe, but is further configured for reaming (i.e., enlarging) the diameter of an existing wellbore as the casing is advanced into the wellbore.

It is also known to employ drill bits configured to be secured to the distal end of a casing string for drilling a wellbore with the casing that is ultimately used to case the wellbore. Drilling a wellbore with such a drill bit attached to the casing used to case the wellbore is referred to in the art as "drilling with casing." Such a drill bit, which is configured to be attached to a section of wellbore casing (as opposed to conventional drill string pipe) is referred to herein as a "casing bit." As used herein, the term "casing bit" also includes reaming shoes.

Casing shoes, reaming shoes, and casing bits may be configured and employ materials in their structures to enable subsequent drilling therethrough from the inside to the outside using a drill bit run down the casing string.

BRIEF SUMMARY

In some embodiments, the present disclosure includes a method of forming a casing bit configured to be coupled to an end of a section of wellbore casing. A cutting element is positioned adjacent an outer surface of a casing bit body. The cutting element comprises a superhard material and a laser-weldable metal alloy layer, and a laser is used to weld the laser-weldable metal alloy layer of the cutting element to the casing bit body.

In additional embodiments, a method of forming a casing bit includes positioning a cutting element adjacent an outer surface of a casing bit body. The cutting element has a superhard material and a brazable metal alloy layer, and the brazable metal alloy layer is brazed to the casing bit body.

Additional embodiments of the disclosure include casing bits fabricated using methods as described herein.

For example, a casing bit configured to be coupled to an end of a section of wellbore casing may include a casing bit body and a cutting element having a superhard material and a laser-weldable metal alloy layer. The laser-weldable metal alloy layer of the cutting element may be welded to a surface of the casing bit body.

As another example, a casing bit configured to be coupled to an end of a section of wellbore casing may include a casing bit body and a cutting element having a superhard material and a brazable metal alloy layer deposited over the superhard material, wherein the brazable metal alloy layer is brazed to a surface of the casing bit body.

BRIEF DESCRIPTION OF THE SEVERAL VIEWS OF THE DRAWINGS

While the specification concludes with claims particularly pointing out and distinctly claiming what are regarded as embodiments of the present invention, various features and advantages of embodiments of the present invention may be more readily ascertained from the following description when read in conjunction with the accompanying drawings, in which:

DETAILED DESCRIPTION

The illustrations presented herein are not actual views of any particular casing bit, drilling assembly, or component thereof, but are merely idealized representations which are employed to describe the present invention.

In accordance with embodiments of the present disclosure, cutting elements that include a volume of superhard material, such as polycrystalline diamond or cubic boron nitride, may be attached to a body of a casing bit using methods that do not result in bond strengths as high as are typically achieved when attaching cutting elements having such superhard materials to bodies of earth-boring tools using conventional methods. As a result, when another drill bit or other drilling tool is subsequently used to drill through the casing bit from the inside of the casing bit to the outside, the cutting elements may more easily detach from the body of the casing bit so as to reduce the likelihood that the drill bit or other tool used to drill through the casing bit will be damaged by the cutting elements of the casing bit. The cutting elements of the casing bit may be sized and otherwise configured to further reduce damage caused to the drill bit or other tool used to drill through the casing bit.

Figure 1:
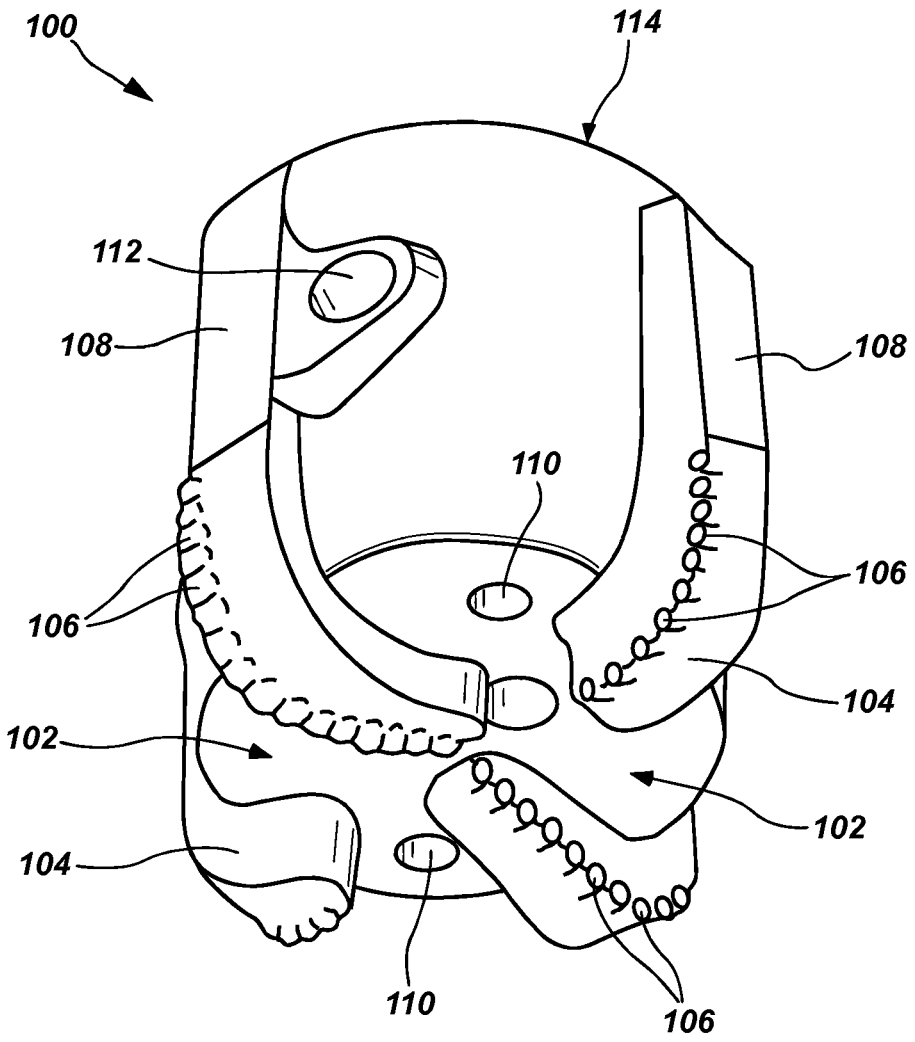
FIG. 1 is a perspective view of an embodiment of a casing bit of the present disclosure including cutting elements bonded to blades of a bit body of the casing bit using methods as described herein.

FIG. 1 is a perspective view of an embodiment of a casing bit 100 of the present disclosure. The casing bit 100 includes a casing bit body 102 having a plurality of blades 104 that project radially outwardly from the surface of the bit body 102, and extend longitudinally along the face of the bit body 102. As discussed in further detail below, the casing bit 100 includes a plurality of cutting elements 106 attached to each of the blades 104. The casing bit 100 has gauge regions 108 that define the maximum gauge diameter of the casing bit 100, and, thus, the diameter of any wellbore formed using the casing bit 100. The gauge regions 108 may be longitudinal extensions of the blades 104. Wear resistant structures or materials may be provided on the gauge regions 108. For example, tungsten carbide inserts, cutting elements, diamonds (e.g., natural or synthetic diamonds), or hardfacing material may be provided on the gauge regions 108 of the casing bit 100.

Fluid ports 110 may extend through the bit body 102 from the interior to the exterior of the bit body 102 to allow drilling fluid to be pumped through the casing bit 100 and out through the fluid ports 110 when the casing bit 100 is attached to casing and used to drill a borehole in a subterranean formation by rotating the casing with the casing bit 100 attached thereto. Optionally, nozzles may be secured to the bit body 102 within the fluid ports 110 to selectively tailor the hydraulic characteristics of the casing bit 100.

In some instances, the size and placement of the fluid ports 110 that are employed for drilling operations may not be particularly desirable for cementing operations. Furthermore, the fluid ports 110 may become plugged or otherwise obstructed during a drilling operation. As shown in FIG. 1, the bit body 102 of the casing bit 100 may include one or more frangible regions 112 that can be breached (e.g., a metal disc that can be burst, fractured, perforated, ruptured, removed, etc.) to form one or more additional apertures that may be used to provide fluid communication between the interior and the exterior of the casing bit 100. Drilling fluid and/or cement optionally may be caused to flow through such frangible regions 112 after breaching the same.

The casing bit 100 may be at least substantially comprised of a material that is sufficiently strong, wear-resistant, and durable so as to allow the casing bit 100 to be used in the drilling operation, but not too strong and wear-resistant to preclude efficiently drilling through the casing bit 100 using another drill bit or other drilling tool after use of the casing bit 100. By way of example and not limitation, the bit body 102 may be at least substantially comprised of a metal alloy, such as a steel alloy. The upper end 114 of the bit body 102 is sized and configured for attachment to casing, as opposed to a conventional drill string as are conventional rotary drill bits.

In accordance with some embodiments of the present disclosure, the cutting elements 106 may include a laser-weldable metal alloy layer or a brazable metal alloy layer, and a welding process or a brazing process may be used to attach the cutting elements 106 to the bit body 102.

Figure 2:
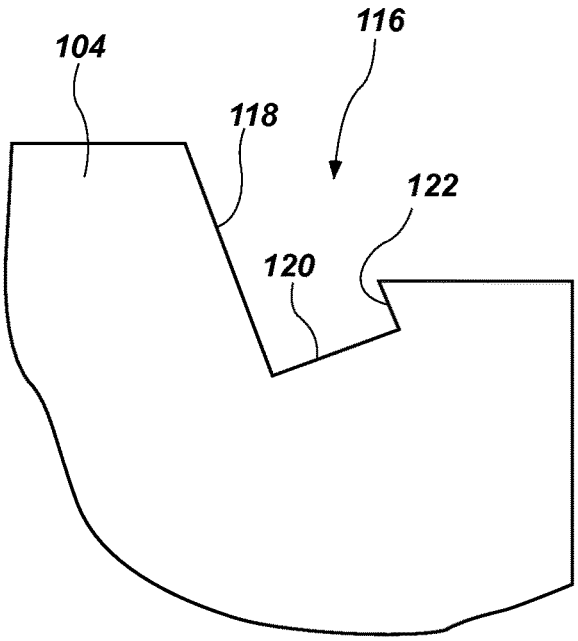
FIG. 2 is a simplified cross-sectional view of a portion of a blade illustrating a recess formed therein in which a plurality of cutting elements may be disposed and bonded to the bit body.
Figure 3:
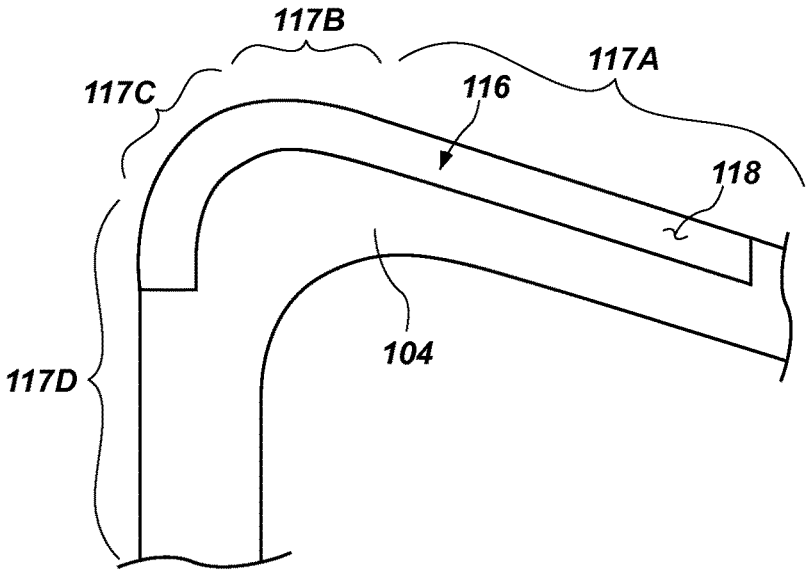
FIG. 3 is a simplified side view of a portion of the blade shown in FIG. 2 and further illustrates the recess formed in the blade in which a plurality of cutting elements may be disposed and bonded to the bit body.

FIG. 2 is a simplified cross-sectional view of a portion of a blade 104 of the bit body 102 of the casing bit 100 of FIG. 1. As shown in FIG. 2, a recess 116 may be formed in the casing bit body on an exterior thereof. The recess 116 may be configured to receive one or more cutting elements therein. As shown in FIG. 3, in some embodiments, the recess 116 may comprise an elongated recess 116 defining a shelf on which a plurality of cutting elements 106 may be supported and attached to the bit body 102. Such an elongated recess 116 may extend one or more of a cone region 117A, a nose region 117B, a shoulder region 117C, and a gauge region 117D of the blade 104.

As shown in FIGS. 2 and 3, the recess 116 may be defined by a back support surface 118 and a lower support surface 120. In some embodiments, the recess 116 may be located and sized such that the recess 116 is also defined by a front surface 122 that extends adjacent a portion of a front cutting face of a cutting element disposed at least partially within the recess 116.

Figure 4:
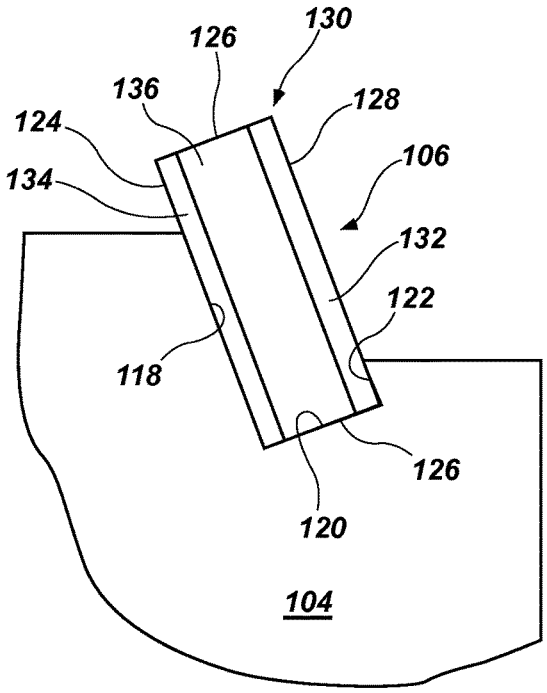
FIG. 4 is a simplified cross-sectional view like that of FIG. 2 illustrating a cutting element disposed in the recess and bonded to the blade of the bit body.

Referring to FIG. 4, a cutting element 106 may be positioned adjacent an outer surface of the casing bit body 102. For example, the cutting element 106 may be positioned at least partially within the recess 116. The cutting element 106 may have a back surface 124 that abuts against and is supported by the back support surface 118 of the bit body 102 in the recess 116. A side surface 126 of the cutting element 106 may abut against and be supported by the lower support surface 120 of the bit body 102 in the recess 116. The cutting element 106 may further include a front cutting face 128, and a front surface 122 in the recess 116 of the bit body 102 may extend over a portion of the front cutting face 128 of the cutting element.

A cutting edge 130 of the cutting element 106 may be defined at the intersection between the front cutting face 128 of the cutting element and the side surface 126 of the cutting element. The cutting element 106 may be oriented on the blade 104 of the bit body 102 such that, as the casing bit 100 is used in a drilling process to drill with casing, and the casing bit 100 is rotated within a wellbore, the cutting edge 130 of the cutting element 106 will scrape against and shear away formation material within the wellbore.

As shown in FIG. 4, the cutting element 106 may include a volume of superhard material 132, such as polycrystalline diamond or cubic boron nitride. The front cutting face 128 of the cutting element 106 may comprise an exposed surface of the volume of superhard material 132. A portion of the side surface 126 also may comprise an exposed surface of the volume of superhard material 132. Polycrystalline diamond comprises diamond grains directly bonded to one another by direct atomic bonds. The polycrystalline diamond is formed by subjecting discrete diamond grains to a high temperatures and high pressures (HTHP) sintering process. For example, the discrete diamond grains may be subjected to pressures of at least about 5.0 GPa and temperatures of at least about 1300° C. in an HTHP sintering press.

A catalyst may be present within the diamond grains during the sintering process to catalyze the formation of the direct inter-granular bonds between the diamond grains, which results in the formation of the polycrystalline diamond material. The catalyst may comprise, for example, an iron group metal (e.g., iron, cobalt, or nickel) or a metal alloy based on an iron group element. After the HTHP sintering process, the catalyst is present in interstitial spaces between the interbonded diamond grains in the volume of polycrystalline diamond material. In some methods, the diamond grains are positioned adjacent a previously formed cobalt-cemented tungsten carbide substrate in the HTHP press. During the HTHP sintering process, molten cobalt from the substrate sweeps into and infiltrates the diamond grains and catalyzes the formation of the inter-granular diamond-to-diamond bonds. In other methods, such a substrate may not be included in the HTHP press, and powdered catalyst may be mixed with the diamond grains prior to disposing the diamond grains in the press and subjecting the diamond grains to the HTHP sintering process.

The cutting element 106 may further comprise a bonding material 134, which is used to bond the cutting element 106 to the bit body 102 as discussed in further detail below. Optionally, a substrate material 136 may be disposed between the volume of superhard material 132 and the bonding material 134. The substrate material 136 may comprise, for example, an abrasive and wear-resistant particle-matrix composite material, such as a cobalt-cemented tungsten carbide. As known in the art, conventional polycrystalline diamond (PCD) cutting elements typically include such a volume of superhard material 132 on a cobalt-cemented tungsten carbide substrate material 136. Optionally, in embodiments in which the superhard material 132 comprises polycrystalline diamond, all or a portion of the catalyst material may be removed from the interstitial spaces between the diamond grains in the superhard material 132 using an acid leaching process or an electrolytic process, for example, such that all or a portion of the superhard material 132 is at least substantially free of the catalyst material. Cutting elements comprising such a superhard material 132 in which the catalyst material has been removed from the superhard material 132 are referred to in the art as "thermally stable" superhard materials, as the presence of the catalyst material in the interstitial spaces has been shown to contribute to fracturing and degradation of the superhard material at elevated temperatures that may be encountered by the superhard material due to friction when the superhard material is used to cut formation material in a drilling process.

Figure 5:
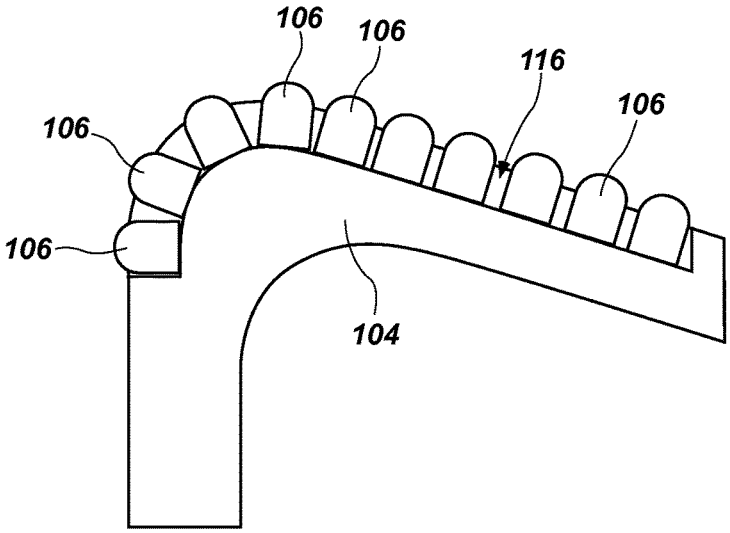
FIG. 5 is a simplified side view like that of FIG. 3 and illustrates a plurality of cutting elements disposed in the recess and bonded to the blade of the bit body.

As shown in FIG. 5, a plurality of cutting elements 106 may be positioned at least partially within the recess 116 in the blade 104 of the bit body 102, and each of the cutting elements 106 may be attached to the bit body 102 within the recess 116.

As previously mentioned, the cutting elements 106 may be attached to the bit body 102 of the casing bit 100 using methods that do not result in bond strengths therebetween as high as are typically achieved when attaching cutting elements having such a volume of superhard material 132 to bodies of earth-boring tools using conventional methods.

In some embodiments, the bonding material 134 of the cutting elements 106 may comprise a laser-weldable metal alloy layer, and a laser may be used to weld the laser-weldable metal alloy layer of the cutting element 106 to the bit body 102 of the casing bit 100. The laser may be configured to generate a laser beam having a relatively high power on the order of, for example, about 1.0 $MW/cm^2$. The spot size of the laser beam may be about 5.0 mm or less, 1.0 mm or less, or even 0.5 mm or less. By employing a laser beam having a small spot size, the heat affected zone may be reduced, and the heating and cooling rates may be increased. The laser device may be a solid-state laser or a gas laser.

By way of example and not limitation, the bonding material 134 may be at least substantially comprised by a metal alloy, such as a cobalt-based alloy, a nickel-based alloy, or an iron-based alloy (e.g., a steel alloy), having a composition that can be welded using a laser.

The cutting element 106 may be positioned within the recess 116 such that the bonding material 134, which comprises the laser-weldable metal alloy layer, is disposed against an outer surface of the casing bit body 102, such as the back support surface 118 within the recess 116. A laser beam then may be directed at the periphery of the of the bonding material 134, and scanned along the intersection between the back support surface 118 and the bonding material 134, both of which may comprise steel, for example. As the laser beam is scanned along the intersection between the back support surface 118 and the bonding material 134, one or both of the back support surface 118 and the bonding material 134 may at least partially melt proximate the interface, resulting in a welded bond between the cutting element 106 and the bit body 102 of the casing bit 100. In such methods, a majority of the back surface 124 of the cutting element 106, as well as a majority of the side surface 126 of the cutting element 106, may remain unbonded to the back support surface 118 of the bit body 102 within the recess 116, which may result in a lower bond strength between the cutting element 106 and the bit body 102 compared to conventional methods of bonding cutting elements to bodies of earth-boring tools. Such a laser welding process may be used to weld the laser-weldable metal alloy layer of each cutting element 106 to the casing bit body 102 within the recess 116.

In other embodiments, the welding process may be performed using one or more of a thermic welding process, an arc welding process, a resistance welding process, or a spot welding process, instead of or in addition to a laser welding process.

In some embodiments, the cutting elements 106 may have a tombstone shape, as shown in FIG. 5. In other embodiments, however, the cutting elements 106 may have a circular shape, an oval shape, a rectangular shape, a triangle shape, a hollow shape, a non-contiguous shape, or any other suitable shape. In some embodiments, the cutting elements 106 may have a shape that allows them to be mechanically interlocked with one another and/or with the bit body 102 upon attachment to the bit body 102.

Figure 6:
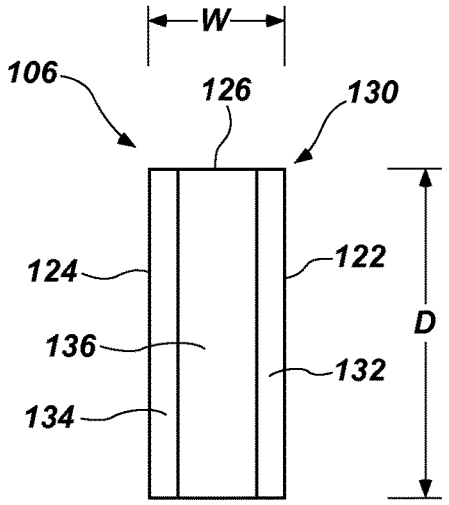
FIG. 6 is a side view of a cutting element that may be employed in embodiments of the present disclosure including a volume of superhard material and a laser-weldable material, with a substrate material therebetween.

As known in the art, cutting elements may be cylindrical, and may have a diameter and a thickness (in the direction extending along the central longitudinal axis of the cutting element). In some embodiments, the cutting elements 106 may have a diameter of about 26 mm or less, about 19 mm or less, about 16 mm or less, about 13 mm or less, or about 8 mm or less. As shown in FIG. 6, in some embodiments, the cutting element 106 may have a maximum dimension D (which may be the diameter or the thickness of the cutting element 106, whichever is greater) of about 13.0 mm or less, about 10.0 mm or less, or even about 8.0 mm or less. By employing such small cutting elements 106, the cutting elements 106 may be less likely to cause damage to another drill bit or other drilling tool subsequently used to drill through the casing bit 100 from the inside to the outside thereof. In some embodiments, the casing bit 100 may not include any cutting element 106 having a maximum dimension D greater than 13 mm.

The cutting element 106 may have a width of between about 1.00 mm and about 20.0 mm, and more particularly between about 2.0 mm and about 10.0 mm. The volume of superhard material 132 may comprise a layer of the superhard material 132 having an average layer thickness of between about 0.1 mm and about 3.0 mm. The bonding material 134 may comprise a layer of the bonding material 134 having an average layer thickness of at least about 0.1 mm, and the average layer thickness of the bonding material 134 may be up to several millimeters thick.

Figure 7:
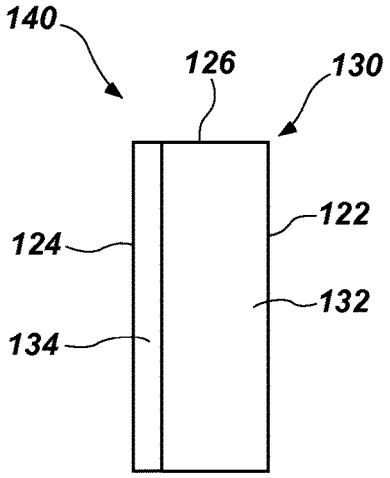
FIG. 7 is a side view of another cutting element that may be employed in embodiments of the present disclosure including a volume of superhard material and a laser-weldable material disposed directly on the superhard material.

As previously mentioned, the substrate material 136 is optional, and FIG. 7 illustrates another embodiment of a cutting element 140 that may be employed in additional embodiments of the disclosure. The cutting element 140 may be configured as previously described in relation to the cutting element 106, except that the cutting element 140 includes only a volume of superhard material 132 and a bonding material 134, without any substrate material 136 therebetween. Optionally, the superhard material 132 may comprise thermally stable polycrystalline diamond substantially free of metal solvent catalyst material in interstitial spaces between interbonded diamond grains in the polycrystalline diamond, as previously discussed herein.

Figure 8:
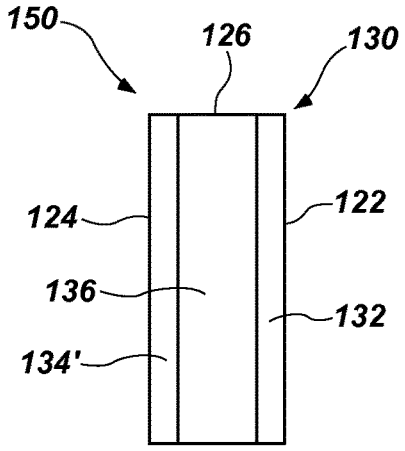
FIG. 8 is a side view of another cutting element that may be employed in embodiments of the present disclosure including a volume of superhard material and a brazable metal alloy material, with a substrate material therebetween.

In yet further embodiments of the present disclosure, a brazing process may be used instead of a welding process to bond the cutting elements to the casing bit 100. For example, FIG. 8 illustrates another embodiment of a cutting element 150 that may be employed in additional embodiments of the disclosure. The cutting element 150 may be configured as previously described in relation to the cutting element 106, except that the cutting element 150 includes a bonding material 134' that comprises a brazable metal alloy layer.

The brazable metal alloy layer may comprise, for example, a cobalt-based brazable metal alloy such as $Co_{67.8}Cr_{19}Si_8B_{0.8}C_{0.4}W_4$ or $Co_{50}Cr_{19}Ni_{17}Si_8W_4B_{0.8}$, a nickel-based brazable metal alloy such as $Ni_{73.25}Cr_{14}Si_{4.5}B_3Fe_{4.5}C_{0.75}$, $Ni_{73.25}Cr_{14}Si_{4.5}B_3Fe_{4.5}$, $Ni_{73.25}Cr_7Si_{4.5}B_3Fe_3C_{0.75}$, $Ni_{82.4}Cr_7Si_{4.5}Fe_3B_{3.1}$, $Ni_{92.5}Si_{4.5}B_3$, $Ni_{94.5}Si_{3.5}B_2$, $Ni_{71}Cr_{19}Si_{10}$, $Ni_{89}P_{11}$, $Ni_{76}Cr_{14}P_{10}$, $Ni_{65.5}Si_7Cu_{4.5}Mn_{23}$, $Ni_{81.5}Cr_{15}B_{3.5}$, $Ni_{62.5}Cr_{11.5}Si_{3.5}B_{2.5}Fe_{3.5}C_{0.5}W_{16}$, $Ni_{67.25}Cr_{10.5}Si_{3.8}B_{2.7}Fe_{3.25}C_{0.4}W_{12.1}$, or $Ni_{65}Cr_{25}P_{10}$. Such cobalt-based and nickel-based brazable metal alloys may exhibit a melting temperature of between about 875° C. and about 1150° C. In additional embodiments, the brazable metal alloy may comprise an aluminum-based brazable metal alloy, a copper-based brazable metal alloy, a silver-based brazable metal alloy, or any other suitable brazable metal alloy. Such brazable metal alloys may have melting points of between 500° C. and about 1150° C. Other alloys, such as silver-based brazable alloys, may flow at braze temperatures of between about 200° C. and about 500° C. If the bit body 102 comprises a heat-treated alloy (e.g., heat-treated steel), it may be desirable to employ a brazable metal alloy having a lower melting point to alloy brazing at lower temperatures and to reduce subjecting any significant portion of the heat-treated bit body 102 to elevated temperatures, which can result in annealing (e.g., grain growth) and reduction of the benefits attained through the heat-treatment of the bit body 102.

Figure 9:
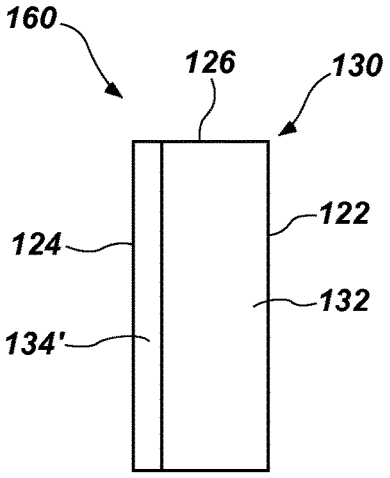
FIG. 9 is a side view of another cutting element that may be employed in embodiments of the present disclosure including a volume of superhard material and a brazable metal alloy disposed directly on the superhard material.

Again, the superhard material 132 optionally may comprise thermally stable polycrystalline diamond. FIG. 9 illustrates another embodiment of a cutting element 160 that may be employed in additional embodiments of the disclosure. The cutting element 160 may be configured as previously described in relation to the cutting element 150 and 106, except that the cutting element 160 includes only a volume of superhard material 132 and a bonding material 134', without any substrate material 136 therebetween.

To attach the cutting elements 150, 160 comprising a brazable metal alloy bonding material 134' to the bit body 102 of the casing bit 100, the cutting elements 150, 160 may be positioned within the recess 116 such that the bonding material 134', which comprises the brazable metal alloy layer, is disposed against an outer surface of the casing bit body 102, such as the back support surface 118 within the recess 116. The brazable metal alloy bonding material 134' then may be heated to cause the brazable metal alloy bonding material 134' to at least partially melt. In some embodiments, the brazing process may be carried out under vacuum as part of a vacuum brazing process. Upon cooling and solidification of the brazable metal alloy bonding material 134', the back surface 124 of the cutting elements 150, 160 will be braze bonded to the back support surface 118 of the bit body 102. If the brazable metal alloy layer covers the entire area of the back surface 124 of the cutting elements 150, 160, a majority of the back surface 124 of the cutting elements 150, 160 may be bonded to the bit body 102, while the side surface 126 of the cutting elements 150, 160 may remain un-bonded to the bit body 102, which may result in a lower bond strength between the cutting element 106 and the bit body 102 compared to conventional methods of bonding cutting elements to bodies of earth-boring tools.

As previously mentioned, in some embodiments, the cutting elements 106 may have a shape that allows them to be mechanically interlocked with one another and/or with the bit body 102 upon attachment to the bit body 102. In a vacuum brazing process, for example, the cutting elements 106 may be assembled together in a manner establishing mechanical interference therebetween and bonded to one another and/or to a blade 104 of the bit body 102 in a vacuum brazing process. In some embodiments, the cutting elements 106 may be assembled and brazed together, and subsequently attached to the blade 104 of the bit body 102 as previously described herein. In additional embodiments, the cutting elements 106 may be assembled and brazed to one another and/or to a blade 104 that is separate from the bit body 102 in a manner establishing mechanical inference therebetween, after which the blade 104 may be attached to the bit body 102 using a brazing and/or welding process. In additional embodiments, the cutting elements 106 may be assembled and brazed to one another and/or to a blade 104 that is separate from the bit body 102 in a manner establishing mechanical interference therebetween, after which the blade 104 may be attached to the bit body 102 using a brazing and/or welding process. In yet further embodiments, the cutting elements 106 may be assembled and brazed to one another and/or to a blade 104 that is attached to or an integral part of the bit body 102, using a brazing and/or welding process as previously described, in a manner establishing mechanical interference therebetween.

In additional embodiments, only a portion of the back surface 124 of the cutting elements 150, 160 may have the brazable metal alloy bonding material 134' thereon, and the area of the back surface 124 covered by the brazable metal alloy bonding material 134' may be selectively tailored to provide a selected bond strength between the cutting elements 150, 160 and the bit body 102. In such embodiments, only a portion of the back surface 124 of the cutting elements 150, 160 may be bonded to the bit body 102. For example, in some embodiments, only 90% or less, 80% or less, 70% or less, or even 50% or less of the back surface 124 of the cutting elements 150, 160 may be bonded to the bit body 102, so as to result in a lower bond strength between the cutting elements 150, 160 and the bit body 102.

Additional non-limiting embodiments of the disclosure are set forth below.

Embodiment 1

A method of forming a casing bit configured to be coupled to an end of a section of wellbore casing, comprising: positioning a cutting element adjacent an outer surface of a casing bit body, the cutting element comprising a superhard material and a laser-weldable metal alloy layer; and using a laser to weld the laser-weldable metal alloy layer of the cutting element to the casing bit body.

Embodiment 2

The method of Embodiment 1, further comprising forming the casing bit body to be at least substantially comprised of a metal alloy.

Embodiment 3

The method of Embodiment 1 or Embodiment 2, further comprising forming a recess in the casing bit body on an exterior thereof, and wherein positioning the cutting element adjacent the outer surface of the casing bit body comprises positioning the cutting element at least partially within the recess in the casing bit body.

Embodiment 4

The method of Embodiment 3, further comprising positioning a plurality of cutting elements at least partially within the recess in the casing bit body, each cutting element of the plurality of cutting elements having a superhard material and a laser-weldable metal alloy layer, and using the laser to weld the laser-weldable metal alloy layer of each cutting element of the plurality of cutting elements to the casing bit body within the recess.

Embodiment 5

The method of any one of Embodiments 1 through 4, wherein positioning the cutting element adjacent the outer surface comprises abutting the laser-weldable metal alloy layer of the cutting element against the outer surface of the casing bit body.

Embodiment 6

The method of Embodiment 5, wherein using the laser to weld the laser-weldable metal alloy layer of the cutting element to the casing bit body comprises welding a periphery of the laser-weldable metal alloy layer to the casing bit body.

Embodiment 7

The method of any one of Embodiments 1 through 6, further comprising selecting the cutting element such that the superhard material comprises polycrystalline diamond.

Embodiment 8

The method of Embodiment 7, further comprising selecting the cutting element such that the superhard material comprises thermally stable polycrystalline diamond substantially free of metal solvent catalyst material in interstitial spaces between interbonded diamond grains in the polycrystalline diamond.

Embodiment 9

The method of any one of Embodiments 1 through 8, further comprising selecting the cutting element such that the laser-weldable metal alloy layer comprises steel.

Embodiment 10

The method of any one of Embodiments 1 through 9, further comprising selecting the cutting element such that the laser-weldable metal alloy layer has an average layer thickness of at least about 0.1 mm.

Embodiment 11

The method of any one of Embodiments 1 through 10, further comprising selecting the cutting element to have a maximum dimension of about 13 mm or less.

Embodiment 12

The method of any one of Embodiments 1 through 11, further comprising forming the casing bit such that the casing bit does not include any cutting element having a maximum dimension greater than 13 mm.

Embodiment 13

A method of forming a casing bit configured to be coupled to an end of a section of wellbore casing, comprising: positioning a cutting element adjacent an outer surface of a casing bit body, the cutting element comprising a superhard material and a brazable metal alloy layer; and brazing the brazable metal alloy layer to the casing bit body.

Embodiment 14

The method of Embodiment 13, further comprising forming a recess in the casing bit body on an exterior thereof, and wherein positioning the cutting element adjacent the outer surface comprises positioning the cutting element at least partially within the recess in the casing bit body.

Embodiment 15

The method of Embodiment 14, further comprising positioning a plurality of cutting elements at least partially within the recess in the casing bit body, each cutting element of the plurality of cutting elements having a superhard material and a brazable metal alloy layer, and brazing the brazable metal alloy layer of each cutting element of the plurality of cutting elements to the casing bit body within the recess.

Embodiment 16

The method of any one of Embodiments 13 through 15, further comprising selecting the cutting element such that the superhard material comprises thermally stable polycrystalline diamond free of metal solvent catalyst material in interstitial spaces between interbonded diamond grains in the polycrystalline diamond.

Embodiment 17

The method of any one of Embodiments 13 through 16, further comprising selecting the cutting element such that the brazable metal alloy comprises a cobalt-based brazable metal alloy, a nickel-based brazable metal, or a silver-based brazable metal alloy.

Embodiment 18

The method of any one of Embodiments 13 through 17, further comprising selecting the cutting element to have a maximum dimension of about 13 mm or less.

Embodiment 19

The method of any one of Embodiments 13 through 18, further comprising forming the casing bit such that the casing bit does not include any cutting element having a maximum dimension greater than 13 mm.

Embodiment 20

A casing bit configured to be coupled to an end of a section of wellbore casing, comprising: a casing bit body; and a cutting element having a superhard material and a laser-weldable metal alloy layer, the laser-weldable metal alloy layer welded to a surface of the casing bit body.

Embodiment 21

The casing bit of Embodiment 20, wherein the casing bit body is at least substantially comprised of a metal alloy.

Embodiment 22

The casing bit of Embodiment 20 or Embodiment 21, further comprising a recess in the casing bit body on an exterior thereof, the cutting element positioned at least partially within the recess in the casing bit body.

Embodiment 23

The casing bit of Embodiment 22, further comprising a plurality of cutting elements positioned at least partially within the recess in the casing bit body, each cutting element of the plurality of cutting elements having a superhard material and a laser-weldable metal alloy layer, the laser-weldable metal alloy layer of each cutting element of the plurality of cutting elements welded to the casing bit body within the recess.

Embodiment 24

The casing bit of any one of Embodiments 20 through 23, wherein only a periphery of the laser-weldable metal alloy layer is welded to the casing bit body.

Embodiment 25

The casing bit of any one of Embodiments 20 through 24, wherein the cutting element has a maximum dimension of about 13 mm or less.

Embodiment 26

The casing bit of any one of Embodiments 20 through 25, wherein the casing bit does not include any cutting element having a maximum dimension greater than 13 mm.

Embodiment 27

A casing bit configured to be coupled to an end of a section of wellbore casing, comprising: a casing bit body; and a cutting element having a superhard material and a brazable metal alloy layer deposited over the superhard material, the brazable metal alloy layer brazed to a surface of the casing bit body.

Embodiment 28

The casing bit of Embodiment 27, wherein the casing bit body is at least substantially comprised of a metal alloy.

Embodiment 29

The casing bit of Embodiment 27 or Embodiment 28, further comprising a recess in the casing bit body on an exterior thereof, the cutting element positioned at least partially within the recess in the casing bit body.

Embodiment 30

The casing bit of Embodiment 29, further comprising a plurality of cutting elements positioned at least partially within the recess in the casing bit body, each cutting element of the plurality of cutting elements having a superhard material and a brazable metal alloy layer deposited over the superhard material, the brazable metal alloy layer of each cutting element of the plurality of cutting elements brazed to the casing bit body within the recess.

Embodiment 31

The casing bit of any one of Embodiments 27 through 30, wherein the cutting element has a maximum dimension of about 13 mm or less.

Embodiment 32

The casing bit of any one of Embodiments 27 through 31, wherein the casing bit does not include any cutting element having a maximum dimension greater than 13 mm.

Although the foregoing description contains many specifics, these are not to be construed as limiting the scope of the present invention, but merely as providing certain embodiments. Similarly, other embodiments of the invention may be devised which do not depart from the scope of the present invention. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A method of forming a casing bit configured to be coupled to an end of a section of wellbore casing, comprising:

positioning a plurality of cutting elements adjacent an outer surface of a casing bit body in a single, common recess of the casing bit body, the common recess defined by a back support surface and a lower support surface formed in the casing bit body, further comprising positioning a back surface and a side surface of each of the plurality of cutting elements against the back support surface and the lower support surface, respectively, of the common recess formed in the casing bit body, each of the plurality of cutting elements comprising a superhard material disposed over a substrate and a weldable metal alloy layer disposed on a side of the substrate opposite the superhard material, the common recess extending continuously across one or more of a cone region, a nose region, a shoulder region, and a gauge region of the casing bit body, the weldable metal alloy layer comprising the back surface of each of the plurality of cutting elements; and laser-welding at least a portion of a periphery of the back surface of the weldable metal alloy layer of each of the plurality of cutting elements to the back support surface of the common recess in the casing bit body, wherein a majority of the back surface of the weldable metal alloy layer of each of the plurality of cutting elements remains un-bonded to the back support surface.

2. The method of claim 1, further comprising forming the casing bit body to be at least substantially comprised of a metal alloy.

3. The method of claim 1, further comprising forming the common recess in the casing bit body on an exterior thereof, and wherein positioning each of the plurality of cutting elements adjacent the outer surface of the casing bit body comprises positioning each of the plurality of cutting elements at least partially within the common recess in the casing bit body.

4. The method of claim 1, wherein positioning each of the plurality of cutting elements adjacent the outer surface of the casing bit body comprises abutting the weldable metal alloy layer of each of the plurality of cutting elements against the outer surface of the casing bit body.

5. The method of claim 1, further comprising selecting at least one of the plurality of cutting elements such that the superhard material comprises polycrystalline diamond.

6. The method of claim 5, further comprising selecting at least one of the plurality of cutting elements such that the superhard material comprises thermally stable polycrystalline diamond substantially free of metal solvent catalyst material in interstitial spaces between interbonded diamond grains in the polycrystalline diamond.

7. The method of claim 1, further comprising selecting at least one of the plurality of cutting elements such that the weldable metal alloy layer comprises steel.

8. The method of claim 1, further comprising selecting at least one of the plurality of cutting elements such that the weldable metal alloy layer has an average layer thickness of at least about 1.0 mm.

9. The method of claim 1, further comprising forming the casing bit such that the casing bit does not include any cutting element having a maximum dimension greater than about 13 mm.

10. The method of claim 1, further comprising selecting each of the plurality of cutting elements to have at least one of a maximum diameter and a maximum thickness of about 13 mm or less.

11. The method of claim 1, further comprising selecting each of the plurality of cutting elements to have a maximum diameter and a maximum thickness of about 13 mm or less.

12. The method of claim 1, further comprising mechanically interlocking each of the plurality of cutting elements with one another and with the casing bit body when the weldable metal alloy layer of the plurality of cutting elements is laser-welded to the back support surface of the recess of the casing bit body.

13. A casing bit configured to be coupled to an end of a section of wellbore casing, comprising:

a casing bit body having a blade with a recess formed therein, the recess extending continuously through at least one of a cone region, a nose region, a shoulder region, and a gage region of the blade, the recess defined by a back support surface and a lower support surface formed in the blade; and a plurality of cutting elements commonly disposed in the recess, each of the plurality of cutting elements having a superhard material disposed over a substrate and a laser-weldable metal alloy layer disposed on a side of the substrate opposite the superhard material, the laser-weldable metal alloy layer comprising a back surface of each of the plurality of cutting elements, the back surface and a side surface of each of the plurality of cutting elements positioned against the back support surface and the lower support surface, respectively, of the recess, at least a portion of a periphery of the back surface of the laser-weldable metal alloy layer welded to the back support surface of the recess formed in the blade of the casing bit body, wherein a majority of the back surface of the laser-weldable material alloy layer of each of the plurality of cutting elements remains un-bonded to the back support surface of the recess.

14. The casing bit of claim 13, wherein the recess extends across each of the cone region, the nose region, the shoulder region, and the gauge region of the blade.

15. The casing bit of claim 13, wherein at least one of the plurality of cutting elements has a tombstone shape.

16. The casing bit of claim 13, wherein each of the plurality of cutting elements has at least one of a maximum diameter and a maximum thickness of about 13 mm or less.

17. The casing bit of claim 13, wherein each of the maximum diameter and the maximum thickness of each of the plurality of cutting elements is about 13 mm or less.

18. The casing bit of claim 13, wherein the plurality of cutting elements are mechanically interlocked with one another and with the casing bit body when the weldable metal alloy layer of each of the plurality of cutting elements is welded to the back support surface of the recess of the blade.

19. The casing bit of claim 13, wherein a majority of a side surface of each of the plurality of cutting elements remains un-bonded to the back support surface of the recess.

* * * * *